United States Patent [19]

Tylisz et al.

[11] Patent Number: 4,651,650

[45] Date of Patent: Mar. 24, 1987

[54] AXLE STABILIZER FOR RAILWAY TRUCK

[75] Inventors: Eugene R. Tylisz, Michigan City, Ind.; Bradford Johnstone, Flossmoor, Ill.

[73] Assignee: Pullman Standard Inc., Chicago, Ill.

[21] Appl. No.: 690,362

[22] Filed: Jan. 9, 1985

Related U.S. Application Data

[63] Continuation-in-part of Ser. No. 575,346, Jan. 31, 1984, abandoned.

[51] Int. Cl.[4] ..... B61F 5/26

[52] U.S. Cl. ..... 105/218.2; 105/199.5; 267/63 A; 280/673

[58] Field of Search ..... 105/224 R, 199 S, 224.1, 105/218 R; 267/63 R, 153, 152, 63 A; 280/673

[56] References Cited

U.S. PATENT DOCUMENTS

| | | | |
|---|---|---|---|
| 2,215,182 | 9/1940 | Latshaw | 267/63 A |
| 3,682,102 | 8/1972 | Pocklington et al. | 105/224 R |
| 4,067,261 | 1/1978 | Scheffel | 105/224.1 |
| 4,173,933 | 11/1979 | Kayserling | 105/224 R |
| 4,334,698 | 6/1982 | Ruf | 267/63 A X |
| 4,406,344 | 9/1983 | Fukushima | 267/63 A X |

FOREIGN PATENT DOCUMENTS

| | | | |
|---|---|---|---|
| 2309702 | 9/1974 | Fed. Rep. of Germany | 105/224.1 |

*Primary Examiner*—Robert B. Reeves
*Assistant Examiner*—Glenn B. Foster
*Attorney, Agent, or Firm*—Richard J. Myers & Assoc.

[57] ABSTRACT

An elastomeric pad placed in shear and having one portion or surface engaged with a portion of a railway car body and another portion or surface engaged by pivotal linkage means to a wheel housing dampens vibrations of a wheel and axle assembly which is resiliently mounted to the car body for rollingly supporting the car body. The pivotal linkage is elongated and connected to the wheel housing and the car body using spherical bearings to minimize wear. The linkage is attached at an angle of inclination to minimize strain on the elastomeric pad and linkage assembly caused by vertical travel of the railway car body due to varying weight loads.

19 Claims, 8 Drawing Figures

AXLE STABILIZER FOR RAILWAY TRUCK

RELATED APPLICATIONS

This application is a continuation-in-part of U.S. Patent Application Ser. No. 575,346, filed Jan. 31, 1984 now abandoned.

BACKGROUND OF THE INVENTION

1. Field of the Invention

This invention relates to a vibration damping device for use on an axle of a railway truck.

2. Description of the Prior Art

Vibration dampers used to prevent sporadic oscillations or "hunting" of an axle of railway trucks are old and well known. Such dampers have generally been of the hydraulic type in which a piston having valving reciprocates within a fluid filled cylinder. The cylinder is generally connected to the car body of the railway car and the piston is connected to the axle housing.

The axle housing, in which an end of the axle is journaled for rotation, is generally engaged with and supports a resilient suspension member, such as a leaf spring, which resiliently supports the car body of the railway car, as well as any cargo with which the car body is laden.

Due to the resiliency of the spring, the axle and the wheels mounted on it tend to, under some conditions, "hunt" at high speeds or make sporadic jerky movements as the truck is forced to accomodtae frequently occuring track curves or rough sections of track. Such movements tend to require a rough, energy inefficient pulling of the car and may, under extreme conditions, cause derailment. Vibration dampers have been used to smooth out or damp such oscillations. These commercially available prior art dampers are of the hydraulic piston and cylinder type having hydraulic flow control valves and relatively complex and expensive seals.

Due to the conditions of stress and temperature extremes in which they are forced to operate, the durability of currently commercially available hydraulic type vibration dampers leave much to be desired. Leakage of fluids and stickikng or wear of valves often cause them to be relatively ineffective and require the need for frequent maintenance, repair or replacement.

SUMMARY OF THE INVENTION

A solid elastomeric pad is interposed between a portion of a railway car body and an axle housing to damper undesirable oscillations of the axle but allow sufficient resilience in curves to provide for steering. The pad, such as a commercially available machine mounting pad, is formed of an elastomeric material sandwiched between and bonded to two metal plates.

One of the plates is affixed to a portion of the car body. The second plate is engaged with a linkage which connects it to an axle housing. Upon commencement of erratic movements by the axle the movements are effectively resisted and controlled through the linkage to the rubber pad placed in shear. The rubber pad thus serves to dampen such movements to maintain the axle running in a smooth, energy efficient manner. Due to the essentially solid state of the elastomeric pad the vibration damper so formed is very durable and maintenance free.

It is further an object of this invention to provide a design of elastomeric shear pad yaw damper where problems of wear and stress on the linkage are minimized.

To accomplish this, the linkage is lengthened considerably, reducing its angular movement relative to its mounts. The linkage is connected to the mounts with spherical bearings, which allow for angular movement without wear. The linkage arm is mounted at an inclined angle when the car is unloaded so that the vertical travel of the railway car due to the variation of weight loads in the car produces minimum strain in the linkage.

DETAILED DESCRIPTION OF THE PREFERRED EMBODIMENT

Figure 1:
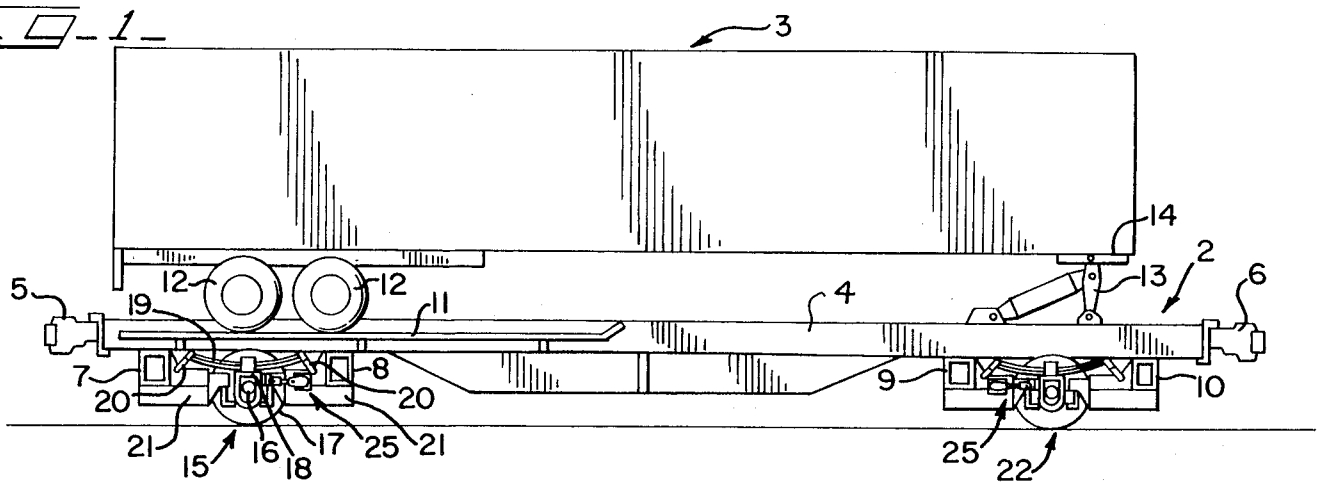
FIG. 1 is a side elevation view of a railway car having trucks having the vibration damper of this invention.

FIG. 1 shows a skeleton type railway car 2 adapted to carry one highway cargo trailer 3. Car 2 has a car body portion comprised of a longitudinally extending center sill 4 having appropriate coupling means, such as conventional railway couplers 5 and 6 at each of its two ends.

A plurality of transverse load carrying members, such as bolsters 7 and 8 and bolsters 9 and 10 are rigidly engaged with center sill 4 and extend transverse to sill 4. Bolsters 7 and 8 serve to support a cargo carrying platform, such as platform 11, on each of two sides of sill 4. The tires 12 of trailer 3 are supported by the platforms. A fifth wheel hitch stanchion 13 is engaged with a portion of sill 4 to engage the fifth wheel 14 of trailer 3 to removably engage the trailer with the railway car.

Bolsters 7 and 8 are rollingly supported by a truck assembly 15 having an axle 16 to which are mounted a pair of wheels, such as wheel 17, which are flanged to rollingly engage a pair of rails.

Axle 16 has at each end an axle housing 18 which supports a resilient suspension means, such as leaf spring 19.

Spring 19 is engaged at each of two ends 20 with a set of links which are engaged with a pair of axle stops 21 cantilevered from and rigidly affixed to bolsters 7 and 8.

Bolsters 9 and 10 serve to be supported on a truck assembly 22 by having substantially the same structure as at truck 15, described immediately above.

Figure 2:
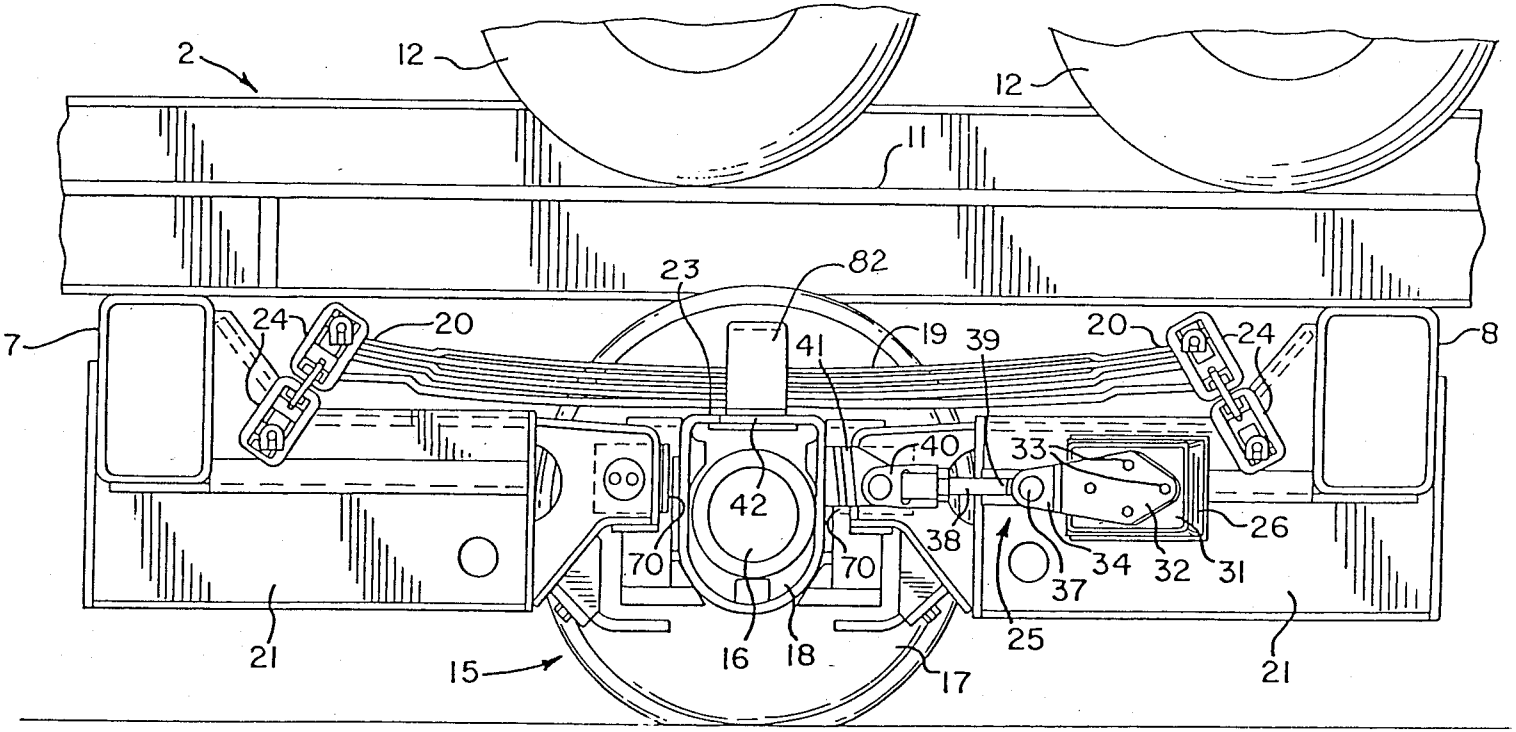
FIG. 2 is an enlarged side elevation view of a truck mounted to a railway car as shown in FIG. 1 and having a vibration damper of this invention.
Figure 3:
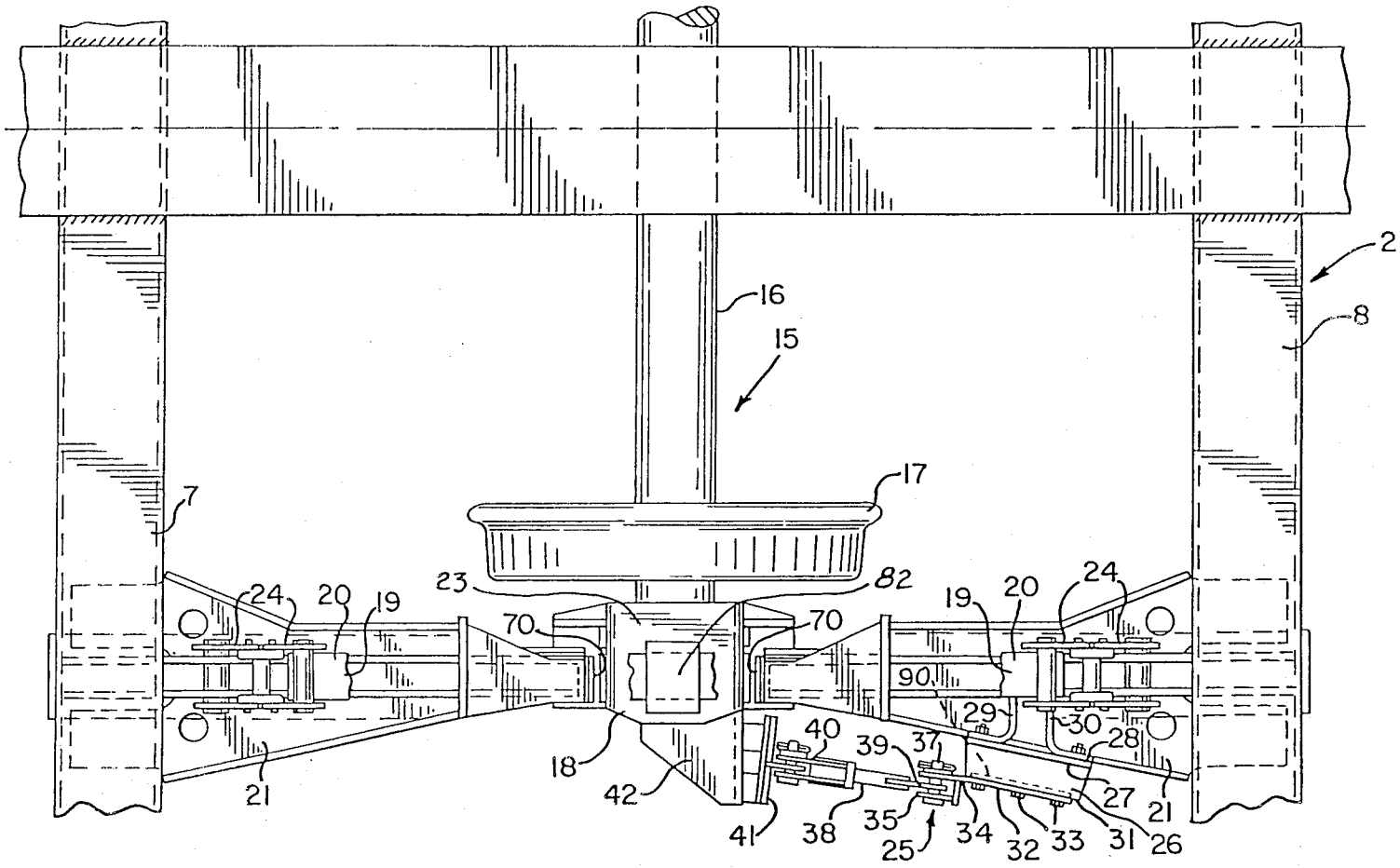
FIG. 3 is a partial top plan view of the truck shown in FIG. 2.
Figure 6:
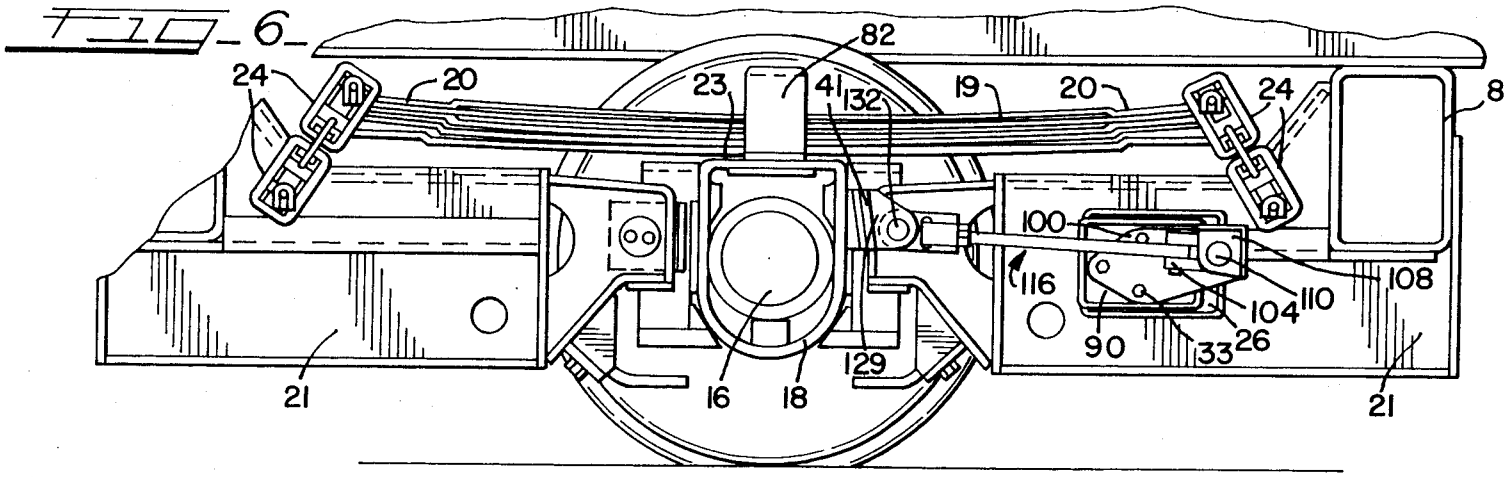
FIG. 6 is a partial side view of the truck in FIG. 5 where the railway car is in a heavy load condition.
Figure 5:
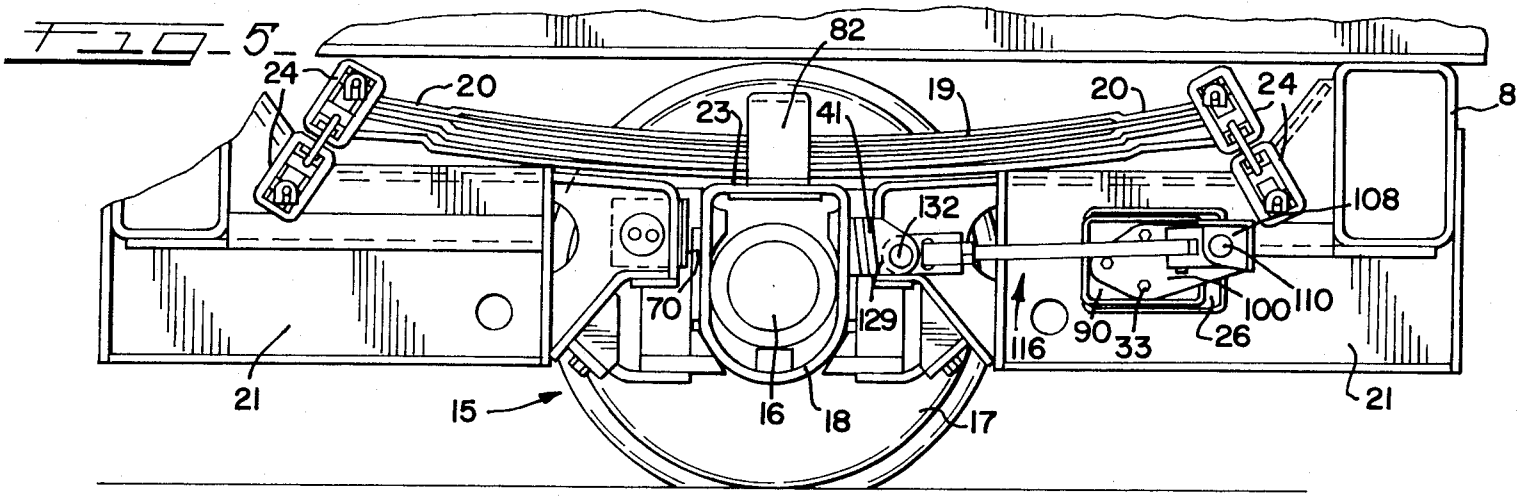
FIG. 5 is a partial side elevation view of a truck mounted to a railway car as shown in FIG. 1, and having the alternate-design vibration damper of this invention where the railway car is in a light load condition.

Referring now to FIGS. 2 and 3, which are enlarged detail views of truck assembly 15 of FIG. 1, it will be seen that spring 19, of which a portion on each side of axle housing 18 has been cut away for clarity in FIG. 3, is surrounded at an intermediate portion by a spring shackle 82 which maintains the intermediate or center portion of the spring 19 supportingly engaged by a top surface portion 23 of axle housing 18. Adjacent the ends 20 of spring 19 the spring is pivotally engaged by pivotally mounted linkage means, such as links 24 to cantilevered axle stop members 21. With this arrangement the axle and wheel assembly is capable of resiliently supporting the car body of car assembly 2 and, due to the resilience of spring 19 and resilience of pad 26 and the pivotally mounted linkage of links 24 of the spring to the car body, the wheel and axle assembly and axle housings can shift laterally, longitudinally and vertically with respect to the car body to enable the railway car to negotiate track curves and anomalies.

However, due to the resilience of the spring, the wheel and axle assembly tends to, under some conditions, undergo sporadic periods of undersirable oscillatory or chattering movement as the wheels seek to follow the tracks. These undesirable "hunting" motions as the wheels seek to follow the track can transmit unwanted vibrations to the car body and its cargo, be detrimental to the track over which the car is travelling and make the car more difficult to pull, which renders it less energy efficient.

As best shown in FIGS. 2 and 3, a solid state shock or motion absorber assembly 25 is connected between a cantilevered axle stop member 21, which is rigidly attached to a bolster 8 and comprises a portion of the rigid car body of railway car 2, and an axle housing 18 resiliently connected to the car body by spring 19.

Shock or motion absorber assembly 25 is comprised of a resilient solid state slab or pad 26 having a first mounting surface 27 to which is attached, such as by bonding, a mounting plate 28. Mounting plate 28 is rigidly affixed to the member 21 by appropriate mounting means, such as mounting brackets 29 and 30, which are affixed to member 21 by appropriate means, such as welding.

Pad 26 has a second surface 31 to which is affixed by appropriate means, such as bonding, a mounting plate 90. A linkage attachment means, such as linkage attachment plate 32, is, as shown, preferably attached to mounting plate 90 of pad 26 by a plurality of mechanical fasteners, such as bolts 33.

Plate 32 has an attachment end portion 34 which extends toward axle housing 18. An attachment means, such as clevis 35, having pivot pin holes 36 is provided at end 34.

A pivot pin 37 engages a linkage member 38 at a first end portion 39. Linkage arm 38 has an opposite end portion 40 pivotally linked to an attachment bracket 41 which is affixed to an axle housing engagement means, such as extension bracket 42, which is rigidly engaged with the axle housing 18.

Figure 4:
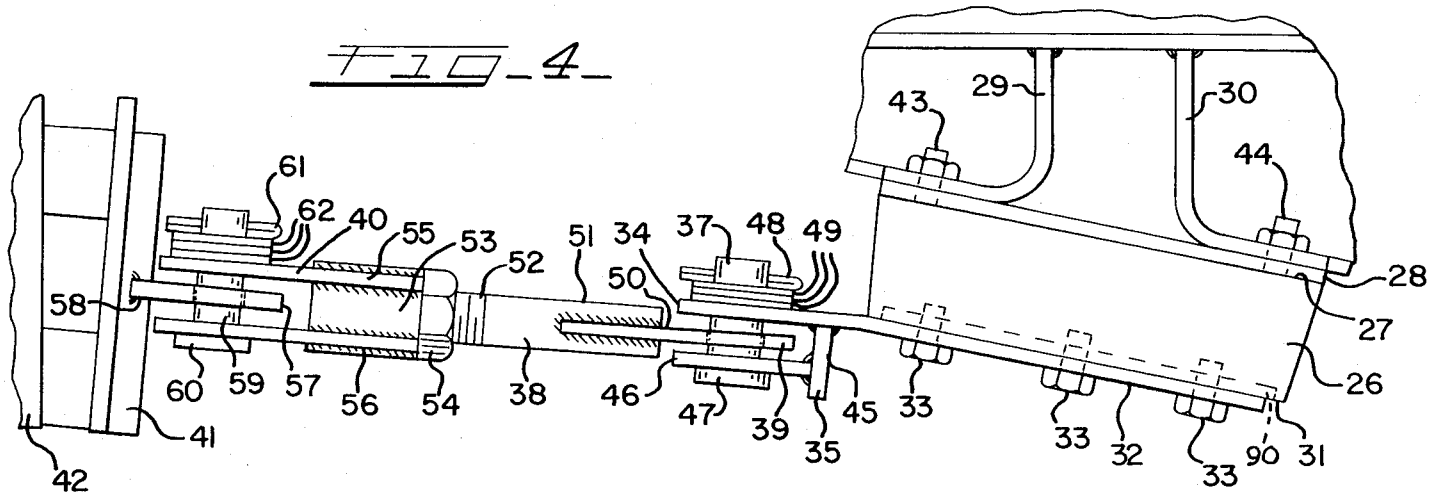
FIG. 4 is an enlarged partial view of FIG. 3 showing the vibration damper in greater detail.

FIG. 4 is an enlarged detail view of damper assembly 25, as shown in FIG. 3. As shown more clearly in this enlarged view attachment plate 28 and elastomeric pad 26 are secured to attachment brackets 29 and 30 by appropriate means, such as mechanical fasteners 43 and 44. Clevis 35 is formed by having a connector bar 45 rigidly affixed to and extending between position 34 of plate 32 and an extension member 46 for forming substantially U-shaped clevis 35.

Cylindrical pivot pin 37 is placed through an opening in each member 34 and 46 and an opening in member 39. The opening in member 39 is just slightly larger than the outside diameter of pin 37 to prevent any substantial longitudinal play or loss of motion between member 39 and 37. With this relationship, movement of linkage 38 is effectively transmitted to plate 32 and linkage 38 is capable of pivotal movement about pin 37 with respect to plate 32. As shown, pin 37 is maintained engaged with clevis 35 by an enlarged head 47 at a first end and removable fastener means, such as cotter key 48, at a second end. A plurality of washers 49 are placed on the pin to prevent end play and rattling.

Linkage member 38 is comprised of a connector member 50 welded to an appropriate member, such as round, bar 51, having a threaded portion 52. Threaded portion 52 is threadedly engaged with a coupling nut 53 and is maintained in a desired relationship by means of a jam nut 54.

A pair of connector plates 55 and 56 are welded to coupling nut 53 in laterally spaced relation as shown to form a substantially U-shaped connection clevis at end 40 of linkag 38.

Attachment bracket 41 has extending longitudinally outwardly from it a connection tongue 57 which is rigidly attached, such as by welding, at end 58 to bracket 41.

A pivot pin 59 is placed through suitable openings in the clevis at end 40 and through an opening in connection tongue 57 to pivotally engage tongue 57 to pivot pin 59. The opening in tongue 57 is slightly larger than the diameter of pin 59 to enable linkage 38 to pivot with respect to tongue 57 and to effectively transmit longitudinal motions from the tongue to the clevis at end 40 without any substantial play, and consequently, without any substantial loss of motion between the connection tongue and the clevis.

Pivot pin 59 is substantially identical to pin 37 as it has an enlarged head 60 at one end and a cotter key 61 and a plurality of washers 62 at the other end to maintain it engaged in the clevis in a substantially non-rattling manner.

An alternate embodiment is shown in FIGS. 5, 6, 7, and 8.

Figure 8:
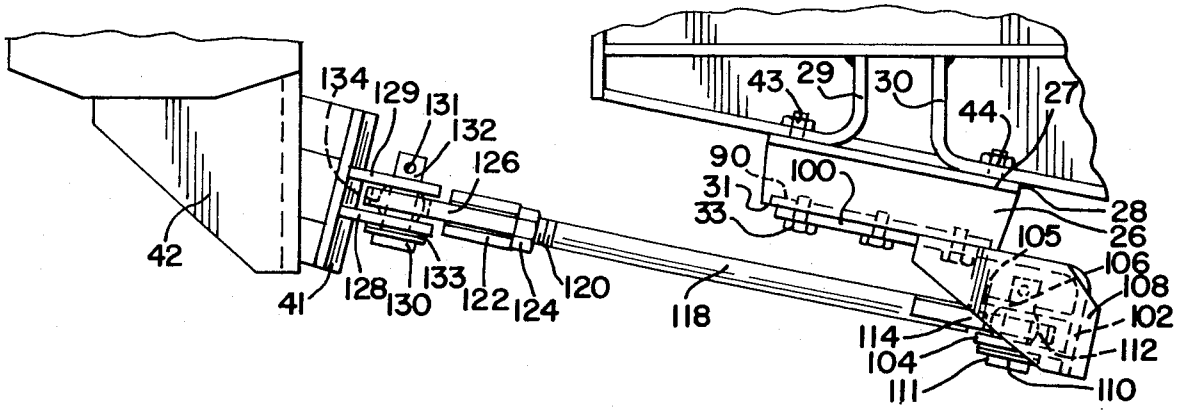
FIG. 8 is an enlarged partial view of FIG. 7 showing the vibration damper in greater detail.

As best shown in FIG. 8, the mounting plate 90 is affixed by appropriate means, such as bonding, to the second surface 31 of pad 26. A linkage attachment plate 100, is, as shown, preferably attached to mounting plate 90 of pad 26 by a plurality of mechanical fasteners, such as bolts 33.

Plate 100 has an attachment end portion 102 which extends away from axle housing 18 and curves to extend away from pad 26. An attachment means, such as clevis 104, having pivot pin holes 106 is provided on end 102. Clevis 104 is formed by having the inside of curved end 102 rigidly affixed to two plates 105 and 107 for forming substantially U-shaped clevis 104. Additional structural support of end 102 and clevis 104 is provided by gusset 108.

Cylindrical pivot pin 110 is placed through an opening in each member 105 and 107 and is journaled through a spherical bearing 112 in linkage end member 114. Linkage end member 114 is attached at one end of linkage 116. The spherical bearing 112 allows for omnidirectional angular movement of linkage 116 without wear on pivot pin 110 or pivot pin holes 106.

As shown, pin 110 is maintained engaged with clevis 104 by an enlarged head 111 at a first end and removable fastener means, such as cotter key 113, at a second end. A plurality of washers 115 are placed on the pin 110 to prevent end play and rattling.

Linkage member 116 is comprised of a linkage end member 114 welded to an appropriate member, such as round bar 118, having a threaded portion 120. Threaded portion 120 is threadedly engaged with a coupling nut 122 and is maintained in a desired relationship by means of a jam nut 124.

A connector plate 126 is welded to coupling nut 122.

Attachment bracket 41 has extending longitudinally outwardly from it a pair of clevis plates 128 and 129 which are rigidly attached, such as by welding, to bracket 41 and form a clevis structure.

A pivot pin 132 is placed through suitable openings in the clevis plates 128 and 129 and through a spherical bearing 134 in connector plate 126 to engage connector plate 126 to pivot pin 132.

The spherical bearing 134 allows for omnidirectional angular movement of linkage 116 with respect to clevis plates 128 and 129 without wear on the clevis plates 128 and 129, the connector member 126, or the pivot pin 132.

Pivot pin 132 is substantially identical to pin 110 as it has an enlarged head 130 at one end and a cotter key 131 and a plurality of washers 133 at the other end to maintain it engaged in the clevis plates 128 and 129 in a substantially non-rattling manner.

DESCRIPTION OF OPERATION

One dampening assembly is preferably placed on each axle housing and therefore each wheel and axle assembly of a single axle truck, as shown, will normally have two dampening structures of this invention. Each of the structures will engage the axle housing in which the axle is journaled for rotation.

Each axle housing is allowed a maximum amount of horizontal movement between axle stop surfaces 70, as best shown in FIG. 3. Also each axle housing is allowed to move vertically with respect to surfaces 70 as the movement of the car body causes flexing of the resilient leaf spring 19 and the pivotally mounted linkage comprised of links 24.

During installation of damper assembly 25 linkage 38 is adjusted lengthwise by turning threaded portion 52 of round bar 51 into or out of coupling nut 53 so that when connector plate 50 is connected with pin 37 axle housing 18 is substantially centered between surfaces 70 under the normal empty weight of the car. Jam nut 54 is then tightened against coupling nut 53 to maintain the desired length of linkage 38.

As car 2 moves, horizontal and vertical forces imposed on an axle housing of the truck are transmitted through the linkage connection from the axle housing into the elastomeric pad with substantially no loss of motion. Due to the resistance to movement of the elastomeric pad in shear the pad effectively serves to absorb and retard motion of the axle housing with respect to the car body and, consequently, provides an effective axle housing stabilizer for an axle housing at each end of the wheel and axle assembly. Although "hunting" is controlled, the pad is sufficiently flexible to allow steering around curves. Also, due to the presence of the pivot pins 37 and 59 linkage 38 enables the axle housing to move vertically up and down with respect to surfaces 70 affixed to the car body and pad 26 imposes a damping effect upon the axle housing as it does move vertically. Also, due to the spacing between the clevises the tongues 39 and 57 are allowed lateral movement along pivot pins 37 and 59, respectively, to enable the axle housing lateral movement with respect to the car body.

The operation of the alternate embodiment shown in FIGS. 5 through 8 inclusive is similar to that of the embodiment described above, but differences are present which reduce wear between the moving parts of the arrangement.

The linkage 116 is mounted between clevis plates 128 and 129 on bracket 41 and clevis 104 attached to elastomeric pad 26.

The connection of the linkage 116 to the clevis 104 at one end the clevis plates 128 and 129 at the other end is accomplished using pivot pins 110 and 132. During the transfer of motion to the elastomeric pad 26, the linkage 116 is deflected in varying directions relative to the pivot pins 110 and 132.

To minimize wear on the linkage 116 during the damping movement, the linkage 116 is made as long as is feasible, extending from the bracket 41 to attachment plate end portion 102. The end portion 102 is located substantially away from the edge of the shear pad 26 which is horizontally closest to the axle housing 18. The added length of the linkage 116 minimizes the angular deflections of the linkage 116 relative to the pivot pins 110 and 132.

Also, spherical bearings 112 and 134 are used for the journal of the pivot pins 110 and 132 in the ends of the linkage 116. This allows the linkage omnidirectional angular deflection relative to the pivot pins 110 and 132 and virtually eliminates wear at the journal of pivot pins 110 and 132 with linkage 116.

Figure 7:
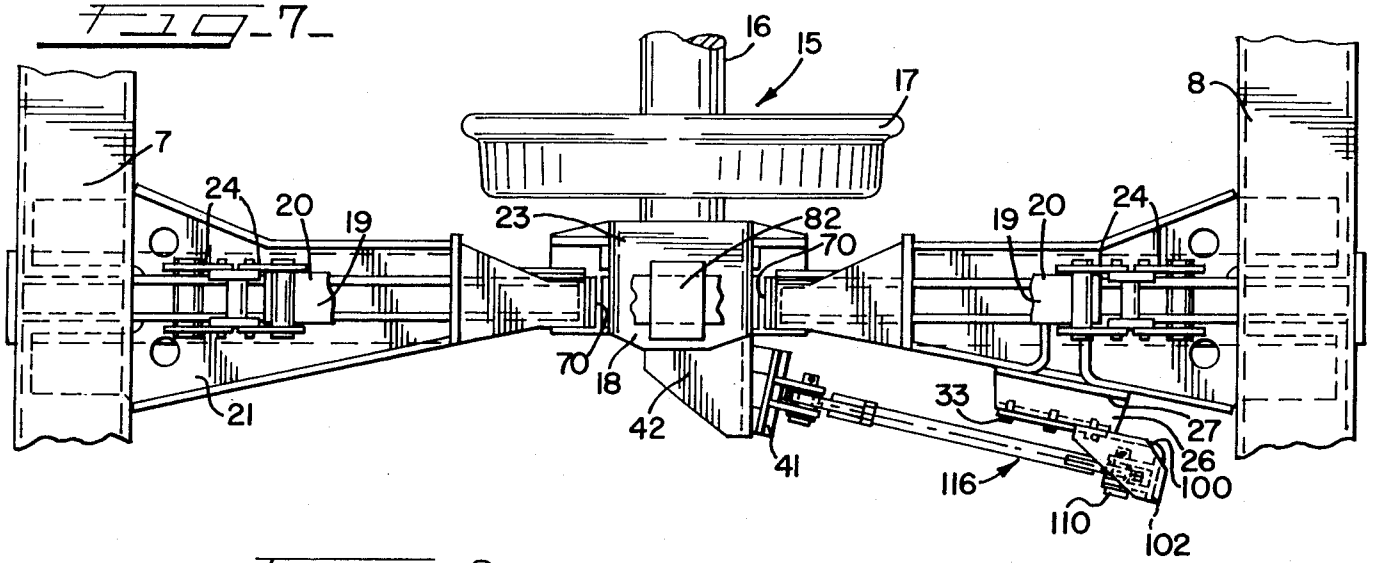
FIG. 7 is a partial top plan view of the truck in FIG. 5.

As shown in FIG. 7, the linkage 116 in the alternate embodiment is mounted at an inclined angle so that when the railway car 2 is in its lightest-load condition, the linkage 116 is higher at pivot pin 110 than at pivot pin 132. As weight is added to the car 2, the additional load presses downward on the spring 19 and causes the car body, including axle stop members 21, the shear pad 26, and the pivot pin 110 to move downward. In its heaviest-load condition, (See FIG. 8), the linkage is lower at pivot pin 110 than at pivot pin 132.

The angle of inclination upward of the linkage 116 and the vertical displacement upward of pin 110 in the lightest-load condition is approximately equal to the angle of deflection downward of the linkage 116 and the vertical displacement downward of pin 110 in the heaviest-load condition.

This arrangement minimizes the longitudinal strain on the linkage 116 and the shear strain on the elastomeric shear pad 26 caused by the vertical travel of the railway car body over the range of loads carried by the car 2.

The foregoing description and drawings merely explain and illustrate the invention and the invention is not limited thereto, except insofar as the appended claims are so limited, as those skilled in the art who have the disclosure before them will be able to make modifications and variations therein without department from the scope of the invention.

What is claimed is:

1. In a railway car having a truck, said truck having an axle having a pair of wheels and two end portions, each of said end portions being journaled for rotation in an axle housing, each of said axle housings engaging and supporting a resilient suspension member supportingly engaged with a car body of the railway car, an improved axle stabilizer comprising:

first engagement means affixed to one of said axle housings;

second engagement means affixed to said car body;

resilient elastomeric movement absorption means affixed to said second engagement means; and linkage means having a first portion operatively associated with said first engagement means and a second portion operatively associated with said solid resilient movement absorption means, said linkage means being substantially rigid lineally for serving to retard said axle housing from oscillating horizontally with respect to said car body;

the linkage means having a first end including first pivot means pivotally connected with the first engagement means and a second end having second pivot means pivotally connected with the resilient elastomeric movement absorption means;

the first and second pivot means permitting pivoted movement of the linkage means in substantially a vertical plane whereby the linkage means transmits primarily the longitudinal movement of the axle housing to the elastomeric movement absorption means to prevent hunting of the axle and wheels and to reduce wear on the elastomeric movement absorption means; and said resilient movement absorption means including:

a linkage connection portion connected with the second pivot means of the linkage means for movement therewith when the axle housing moves longitudinally;

an intermediate portion connected with the linkage connection portion and extending therefrom in a direction generally perpendicular to said vertical plane; and a body connection portion being connected with the second engagement means to remain substantially fixedly positioned with respect to said car body, said body connection portion being connected with the intermediate portion and being positioned away from the linkage connection portion along said direction generally perpendicular to the vertical plane whereby longitudinal movement of the axle housing with respect to the car body is damped to prevent hunting of the wheels by the resilience in shear of the resilient movement absorption means throughout the range of vertical movement of the axle housing with respect to the car body responsive to varying loads on the suspension member.

2. The invention as defined in claim 1 together with linear length adjustment means in said linkage means for lengthening or shortening said linkage means.

3. The invention as defined in claim 1 in which said second engagement means is a rigid plate rigidly affixed to said car body and said body connection portion of said resilient movement absorption means is bonded to said plate.

4. The invention as defined in claim 3 in which said linkage connection portion of said resilient movement absorption means is bonded to a mounting plate, and a second plate is rigidly engaged with said mounting plate and said second portion of said linkage means is engaged with said second plate.

5. The invention as defined in claim 1 in which said first engagement means is an attachment bracket rigidly affixed to said axle housing.

6. An improved movement damping assembly for retarding movement of an axle housing of railway car truck with respect to the railway car car body, said damping assembly comprising an elastomeric pad having a first engagement means rigidly affixed to a portion of the railway car body, linkage attachment means affixed to a portion of said pad for placing said pad in shear between said first engagement means and said linkage attachment means, linkage means having a first and a second end, said first end being pivotally engaged with said linkage attachment means, and said second end being pivotally engaged with the axle housing of the railway car truck for enabling said axle housing to move vertically with respect to said car body and for retarding longitudinal oscillatory movement of said axle housing with respect to said car body to prevent hunting; and said linkage attachment means being positioned transversely of the first engagement means with respect to the linkage means whereby the pad damps longitudinal movement of the axle housing by the resiliency of the pad in shear; and said pad extending substantially horizontally between said linkage attachment means and said first engagement means whereby longitudinal movement of the axle housing is damped by the resilience of the pad in shear throughout the range of vertical movement of the axle housing with respect to the car body.

7. A movement controlling assembly for controlling movement of an axle housing of a railway car truck of a railway car with respect to a car body of said railway car, said controlling assembly comprising:

an elastomeric pad having a first surface portion affixed to a car body engagement means, said car body engagement means being affixed to a portion of said car body of said railway car, said pad having a second surface portion affixed to a first linkage engagement means;

second linkage engagement means being engaged with said axle housing; and linkage means extending between and engaged with each said first and second linkage engagement means to transmit movement of the axle housing to the elastomeric pad to damp longitudinal movement of the axle housing to prevent hunting; and said car body engagement means and said linkage means being spaced from each other in a generally horizontal direction transverse to the linkage means for placing the pad in shear therebetween;

said elastomeric pad having an intermediate portion connecting the first and second surface portions and extending therebetween generally transversely with respect to the linkage means to damp the longitudinal movement of the axle housing by resilience in shear; and said intermediate portion extending substantially horizontally between the first and second surface portions whereby longitudinal movement of the axle housing with respect to the car body is damped by the resilience in shear of the pad throughout the range of vertical movement of the axle housing with respect to the car body.

8. The invention according to claim 7, and the linkage means having first pivot means pivotally connecting the linkage means with said first linkage engagement means, said first pivot means providing for pivoted movement of the linkage means in a generally vertical plane to reduce stress on the pad due to vertical movement of the axle housing with respect to the car body.

9. The invention according to claim 8, and said first linkage engagement means having an opening therein;

said first pivot means including a substantially horizontally disposed cylindrical pivot pin extending into the opening in the first linkage engagement means.

10. In a railway car having a truck, said truck, having an axle having a pair of wheels and two end portions, each of said end portions being journaled for rotation in an axle housing, each of said axle housing engaging and supporting a resilient suspension member supportingly engaged with a car body of the railway car, an improved axle stabilizer comprising:

first engagement means affixed to one of said axle housings;

second engagement means affixed to said car body;

resilient elastomeric movement absorption means having linkage engagement means thereon and being affixed to said second engagement means; and linkage means having a first portion having first pivot means pivotally engaged with first engagement means and a second portion having second pivot means pivotally engaged with said linkage engagement means on said resilient movement absorption means to damp movement of the axle housing for prevention of hunting;

said first and second pivot means allowing pivoted movement of said linkage means in a generally vertical plane for enabling said axle housing to move vertically with respect to said car body with reduced wear on the resilient elastomeric movement absorption means and said linkage means being substantially rigid lineally for serving to retard said axle housing from oscillating horizontally with respect to said car body; and said first and second pivot means including spherical bearing means for reducing wear between said linkage means and said first engagement means and said linkage engagement means during lateral movement of said axle housing with respect to the car body; and said resilient movement absorption means including;

a linkage connection portion connected with the second portion of the linkage means for movement therewith when the axle housing moves longitudinally;

an intermediate portion connected with the linkage connection portion and extending therefrom in a direction generally perpendicular to said generally vertical plane; and a body connection portion being connected with the second engagement means to remain substantially fixedly positioned with respect to said car body, said body connection portion being connected with the intermediate portion and being positioned away from the linkage connection portion along said direction generally perpendicular to the generally vertical plane whereby longitudinal movement of the axle housing with respect to the car body is damped to prevent hunting of the wheels by the resilience in shear of the resilient movement absorption means throughout the range of vertical movement of the axle housing with respect to the car body responsive to varying loads on the suspension member.

11. In a railway car having a truck, said truck having an axle having a pair of wheels and two end portions, each of said end portions being journaled for rotation in an axle housing, each of said axle housing engaging and supporting a resilient suspension member supportingly engaged with a car body of the railway car, an improved axle stabilizer comprising:

first engagement means affixed to one of said axle housings;

second engagement means affixed to said car body;

resilient elastomeric movement absorption means having linkage engagement means thereon and being affixed to said second engagement means;

linkage means having a first portion engaged with said first engagement means and a second portion engaged with said linkage engagement means on said solid resilient movement absorption means;

said linkage means having pivot means for enabling said axle housing to move vertically and laterally with respect to said car body and said linkage means being substantially rigid lineally for serving to retard said axle housing from oscillating horizontally with respect to said car body; and said resilient elastomeric movement absorption means comprising:

a first portion connected with the linkage engagement means;

a second portion connected with the second engagement means; and said linkage engagement means and said second engagement means being spaced from each other in a generally horizontal direction transverse to the linkage means for placing the resilient movement absorption means in shear therebetween;

an intermediate portion connecting said first and second portions of the movement absorption means and extending therebetween generally transversely with respect to the linkage means to damp the longitudinal movement of the axle housing by the resilience in shear of the movement absorption means to prevent hunting; and said intermediate portion extending substantially horizontally between the first and second portions whereby longitudinal movement of the axle housing with respect to the car body is damped by the resilience is shear of the movement absorption means throughout the range of vertical movement of the axle housing with respect to the car body; and the first engagement means being positioned relative to the second engagement means so that the second portion of the linkage means is relatively higher than the first portion of the linkage means when the car is in lightest-load condition and the second portion is relatively lower than the first portion when the car is in its heaviest-load condition, thereby reducing longitudinal strain in the axle stabilizer due to vertical travel of the car body responsive to varying loads.

12. The invention according to claim 11, and the vertical displacement upward of the second portion relative to the first portion in the lightest-load condition is approximately equal to the vertical displacement downward of the second portion relative to the first portion in the heaviest-load condition, thereby minimizing longitudinal strain in the axle stabilizer due to vertical travel of the car body responsive to different weight loads.

13. In a railway car having a truck, said truck having an axle having a pair of wheels and two end portions, each of said end portions being journaled for rotation in an axle housing, each of said axle housings engaging and supporting a resilient suspension member supportingly engaged with a car body of the railway car, an improved axle stabilizer comprising;

first attaching means affixed to one of said axle housings;

second attaching means affixed to said car body;

resilient elastomeric movement absorption means affixed to said second attaching means;

linkage attachment means connected with the resilient movement absorption means and extending therefrom generally away from the axle housing;

linkage means having a first portion pivotally engaged with said first attaching means and a second portion pivotally engaged with said linkage attachment means for transmitting longitudinal movement of the axle housing to the resilient movement absorption means to prevent hunting of said truck;

said linkage means being substantially rigid lineally for serving to retard said axle housing from oscillating horizontally with respect to said car body; and said linkage means extending from the first attaching means and away from the axle housing and pivotally engaging the linkage attachment means longitudinally beyond the movement absorption means to result in a longer linkage means for a given location of the movement absorption means thereby reducing the angular deflection of said linkage means relative to said first attaching means and said linkage attachment means and limiting resulting wear; and the resilient elastomeric movement absorption means extending between the linkage attachment means and the second attaching means in a substantially horizontal direction generally transverse to the linkage means whereby the longitudinal movement of the axle housing with respect to the car body is damped throughout the range of vertical movement of the axle housing with respect to the car body by the resilience in shear of the movement absorption means.

14. The invention according to claim 13, and said linkage means being generally connected to the end of said linkage attachment means furthest removed longitudinally from said axle housing.

15. The invention according to claim 13, and the first attaching means being positioned with respect to the second attaching means so that the second portion of the linkage means is relatively higher than the first portion of the linkage means when the car is in lightest-load condition and the second portion is relatively lower than the first portion when the car is in heaviest-load condition, thereby reducing longitudinal strain in the axle stabilizer due to vertical travel of the car body responsive to varying loads.

16. The invention according to claim 15, and the vertical displacement upward of the second portion relative to the first portion in the lightestload condition is approximately equal to the vertical displacement downward of the second portion relative to the first portion in the heaviest load condition, thereby minimizing longitudinal strain in the axle stabilizer due to vertical travel of the car body responsive to varying loads.

17. The invention according to claim 13, and the first and second portions of the linkage means including spherical bearing means whereby wear due to angular deflection of the linkage means relative to the first and second engagement means is reduced.

18. The invention according to claim 13, and the resilient elastomeric movement absorption means comprising an elastomeric pad having a first side surface affixed to the second attaching means and a second side surface opposite said first side surface, and a linkage attachment member affixed to said second side surface and attached to the second portion of the linkage means, whereby oscillation of the axle housing is damped by the in shear resilience of the elastomeric pad.

19. The invention according to claim 13, and the resilient elastomeric movement absorption means comprising:

an elastomeric portion affixed to the attaching means and said linkage attachment means including an attachment portion affixed to the elastomeric portion and an end portion being connected with the attachment portion at the end of the attachment portion furthest longitudinally from the axle housing and said end portion being connected with the linkage means, whereby the extended length of the linkage means reduces the angular deflection of the linkage means relative to the first attaching means and the end portion during damping of movement of the axle housing.

* * * * *